US009127879B2

(12) United States Patent
Hwang et al.

(10) Patent No.: US 9,127,879 B2
(45) Date of Patent: Sep. 8, 2015

(54) REFRIGERATOR HAVING DOOR OPENING UNIT

(71) Applicant: LG Electronics Inc., Seoul (KR)

(72) Inventors: Jungyeon Hwang, Gyeongnam (KR); Seonkyu Kim, Gyeongnam (KR); Seungjin Yoon, Gyeongnam (KR); Woonkyu Seo, Gyeongnam (KR); Daesung Lee, Gyeongnam (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 14/358,843

(22) PCT Filed: Nov. 2, 2012

(86) PCT No.: PCT/KR2012/009197

§ 371 (c)(1),
(2) Date: May 16, 2014

(87) PCT Pub. No.: WO2013/094872

PCT Pub. Date: Jun. 27, 2013

(65) Prior Publication Data

US 2014/0319989 A1 Oct. 30, 2014

(30) Foreign Application Priority Data

Nov. 16, 2011 (KR) ..... 10-2011-0119634

(51) Int. Cl.

| | |
|---|---|
| ***F25D 23/00*** | (2006.01) |
| ***F25D 23/02*** | (2006.01) |
| ***F25D 25/02*** | (2006.01) |

(52) U.S. Cl.

CPC ..... *F25D 23/028* (2013.01); *F25D 23/00* (2013.01); *F25D 23/02* (2013.01); *F25D 25/025* (2013.01)

(58) Field of Classification Search

CPC ..... F25D 23/02; F25D 23/028; F25D 23/08; F25D 11/00; F25D 25/025; Y10T 16/458; E05B 17/0033

See application file for complete search history.

(56) References Cited

U.S. PATENT DOCUMENTS 5,908,228 A * 6/1999 Lee ..... 312/405
7,984,955 B2 * 7/2011 Jung et al. ..... 312/405

(Continued)

FOREIGN PATENT DOCUMENTS

EP 2 093 528 A2 8/2009
EP 2 333 463 A2 6/2011

(Continued)

OTHER PUBLICATIONS

International Search Report dated Feb. 5, 2013 for Application No. PCT/KR2012/009197, 2 pages.

*Primary Examiner* — Daniel Rohrhoff
(74) *Attorney, Agent, or Firm* — Fish & Richardson P.C.

(57) ABSTRACT

Disclosed is a refrigerator having a door opening unit (100), and more particularly is a refrigerator which provides easier opening of a door that is used to open and close a storage compartment. The refrigerator includes a main body having a storage compartment, a door coupled to the main body in a slidingly movable manner to open and close the storage compartment, a handle (120) provided at the door in a pivotally rotatable manner, and a door opening unit (100) connected to the handle (120) to come into contact with the main body. The door opening unit (100) serves to move the door by applying pressure to the main body via pivotal rotation of the handle (120), thereby opening the storage compartment.

18 Claims, 5 Drawing Sheets

(56) References Cited

U.S. PATENT DOCUMENTS

| | | | | |
|---|---|---|---|---|
| 2006/0021284 | A1* | 2/2006 | Benz | 49/477.1 |
| 2008/0000052 | A1* | 1/2008 | Hong et al. | 16/382 |
| 2008/0163462 | A1* | 7/2008 | King | 16/412 |
| 2008/0282505 | A1* | 11/2008 | Kim | 16/412 |
| 2009/0005357 | A1* | 1/2009 | Radulovacki et al. | 514/211.13 |
| 2009/0179540 | A1* | 7/2009 | Seo | 312/405 |
| 2009/0205357 | A1 | 8/2009 | Lim | |
| 2011/0132024 | A1 | 6/2011 | Lim | |
| 2011/0297686 | A1 | 12/2011 | Lim | |
| 2013/0270990 | A1* | 10/2013 | Park et al. | 312/404 |
| 2014/0203698 | A1* | 7/2014 | Kim et al. | 312/404 |

FOREIGN PATENT DOCUMENTS

| | | | |
|---|---|---|---|
| JP | 2004-116842 | A | 4/2004 |
| TR | 2010-05873 | A2 | 11/2010 |
| WO | WO 2012/007239 | A2 | 1/2012 |

* cited by examiner

REFRIGERATOR HAVING DOOR OPENING UNIT

CROSS REFERENCE TO RELATED APPLICATIONS

This application is a U.S. National Phase Application under 35 U.S.C. §371 of International Application No. PCT/KR2012/009197, filed on Nov. 2, 2012, which claims priority to Korean Application No. 10-2011-0119634, filed on Nov. 16, 2011, the entire content of the prior applications is hereby incorporated by reference.

TECHNICAL FIELD

The present invention relates to a refrigerator having a door opening unit, and more particularly to a refrigerator which provides easier opening of a door that is used to open and close a storage compartment.

BACKGROUND ART

A refrigerator is an apparatus that keeps stored items at a freezing temperature or less or at a temperature slightly above freezing using a refrigerant cycle that consists of compression, condensation, expansion and evaporation.

Such a refrigerator includes a freezing compartment, a refrigerating compartment, and doors to open and close these compartments. Based on a configuration of the refrigerator, the doors may be configured to open and close the freezing compartment and the refrigerating compartment via pivotal rotation thereof, or may be configured to open and close the freezing compartment or the refrigerating compartment via forward and rearward sliding thereof.

In particular, in the case of many refrigerators used in the United States and Europe, a bottom freezer type refrigerator in which a refrigerating compartment occupies an upper region of a main body and a freezing compartment occupies a lower region of the main body is employed in consideration of the fact that the refrigerating compartment is more frequently used.

Based on the above described configuration, the refrigerating compartment is provided with a pivotally rotatable door, and the freezing compartment is provided with a sliding door.

In the case of the door to open and close the freezing compartment, in particular, a pair of guide rails is provided to extend from both lateral sides of a rear surface of the door. The guide rails are connected to support portions formed at both lateral sides of the interior of the freezing compartment to enable sliding of the door.

However, when weak users, such as the elderly and infirm persons, women and children, pull the sliding door, many users suffer from physical fatigue due to a heavy weight of the sliding door.

Accordingly, in the case of the sliding door, there is a demand for a method or configuration for easy opening of the door with less effort.

DISCLOSURE OF INVENTION

Technical Problem

An object of the present invention is to satisfy the above described demand and to provide a refrigerator having a door opening unit to achieve easier opening of a sliding door.

Solution to Problem

The object of the present invention can be achieved by providing a refrigerator including a main body having a storage compartment, a door coupled to the main body in a slidingly movable manner to open and close the storage compartment, a handle provided at the door in a pivotally rotatable manner, and a door opening unit connected to the handle to come into contact with the main body, the door opening unit serving to move the door by applying pressure to the main body via pivotal rotation of the handle, thereby opening the storage compartment, wherein the door opening unit includes a support frame configured to support the handle in a pivotally rotatable manner, a plurality of push units inserted into the handle and spaced apart from each other within the door, an upper portion of each push unit being movable to or from the main body via pivotal rotation of the handle, and a plurality of pressure units configured to come into contact with the plurality of push units, respectively, and adapted to be selectively moved by movement of the push units, the pressure units being spaced apart from one another within the door to cause sliding of the door by applying pressure to a partition of the main body.

The door opening unit may be configured to come into contact with a front surface of the main body and may apply pressure to the front surface of the main body so as to move the door upon pivotal rotation of the handle.

The door may include a door panel placed at a front surface of the door, and an opening formed in the door panel to define a space for pivotal rotation of the handle, the handle and the door opening unit being mounted in the space.

The handle may include a grip part configured to enable gripping by a user, a pivot shaft pivotally rotatably provided at the support frame and serving as a pivot center, a connecting part configured to connect the grip part and the pivot shaft to each other, and a moving part provided at an end of the pivot shaft and having an insertion hole, into which a corresponding one of the push unit is inserted, the moving part serving to pull a lower portion of the push unit and move an upper portion of the push unit toward the main body when the handle is pivotally rotated forward.

The handle may further include a handle cover affixed to a front surface of the grip part.

The support frame may include a body mounted to the door, a space formed in the body to define a pivotal rotation space of the handle in conjunction with the opening, and an insertion hole formed in the body, into which the handle is inserted and supported in a pivotally rotatable manner.

The support frame may include a plurality of protrusions protruding rearward from a rear surface of the support frame, the protrusions being coupled to an insulating member placed in the door, and the protrusions may be arranged on the rear surface of the support frame and are spaced apart from one another.

The refrigerator may further include a support unit to pivotally rotatably support each push unit.

The push unit may include a lower portion configured to be inserted into the handle so as to be moved according to movement of the handle, an upper portion configured to come into contact with a corresponding one of the pressure units, the upper portion serving to selectively push the pressure unit toward the main body according to movement of the lower portion, and a support shaft provided between the lower portion and the upper portion, the support shaft being pivotally rotatably inserted into the support unit to pivotally rotatably support the push unit.

Each of the pressure units may include a contact part configured to come into contact with a corresponding one of the push units and be moved by pushing operation of the push unit, and a pressure part connected to the contact part and configured to come into contact with the main body to apply pressure to the main body according to movement of the contact part.

The pressure unit may further include a pressure rib provided at an end of the pressure part and configured to increase a contact area with the main body.

The pressure part may be placed to horizontally extend, and the contact part may be connected to the pressure part and is placed to vertically extend.

The refrigerator may further include a guide unit configured to support the pressure unit in a slidingly movable manner, the guide unit serving to guide movement of the pressure unit.

The guide unit may include a support part placed on an upper surface of the door and configured to support the contact part in a slidingly movable manner, and an elastic support part provided at the support part and configured to elastically support the contact part for provision of elastic restoration force.

The support part may include a lower surface support part configured to support a lower surface of the contact part, and a lateral surface support part configured to extend upward from a lateral surface of the lower surface support part so as to support a lateral surface of the contact part.

The refrigerator may further include a top cover placed over the door and having a guide slot to guide movement of a corresponding one of the pressure units exposed therethrough, and a top panel placed over the top cover and configured to prevent exposure of the top cover and the pressure unit.

In accordance with another aspect of the present invention, there is provided a refrigerator including a main body having a storage compartment, a door coupled to the main body in a slidingly movable manner to open and close the storage compartment, a handle provided at the door in a pivotally rotatable manner, and a door opening unit connected to the handle to come into contact with the main body, the door opening unit serving to move the door by applying pressure to the main body via pivotal rotation of the handle, thereby opening the storage compartment, wherein the door opening unit is configured to come into contact with a front surface of the main body and applies pressure to the front surface of the main body so as to move the door upon pivotal rotation of the handle.

Advantageous Effects of Invention

According to the present invention, easier opening of a door, which is coupled in a slidingly movable manner to a main body of a refrigerator, may be accomplished with less force.

That is, when a handle is pivotally rotated to open the door, pivotal rotation of the handle is converted into horizontal movement of a pressure unit. As force caused by the horizontal movement is applied to a front surface of the main body, the door is spaced apart from the main body to thereby be opened away from the main body.

In particular, if the door is slightly spaced apart from a storage compartment to release airtightness between the door and the storage compartment, an interior pressure of the storage compartment and an outside atmospheric pressure become substantially equal, which ensures easy opening of the door.

In particular, since opening of the door is mechanically realized without an electrical component such as a motor, there is no problem due to an electrical configuration.

BRIEF DESCRIPTION OF DRAWINGS

The accompanying drawings, which are included to provide a further understanding of the invention, illustrate embodiments of the invention and together with the description serve to explain the principle of the invention.

In the drawings:

FIG. 4(*b*) is a perspective view of a handle according to the present invention;

FIG. 5(*b*) is an assembled perspective view of the push unit and the pressure unit according to the present invention;

BEST MODE FOR CARRYING OUT THE INVENTION

Figure 1:
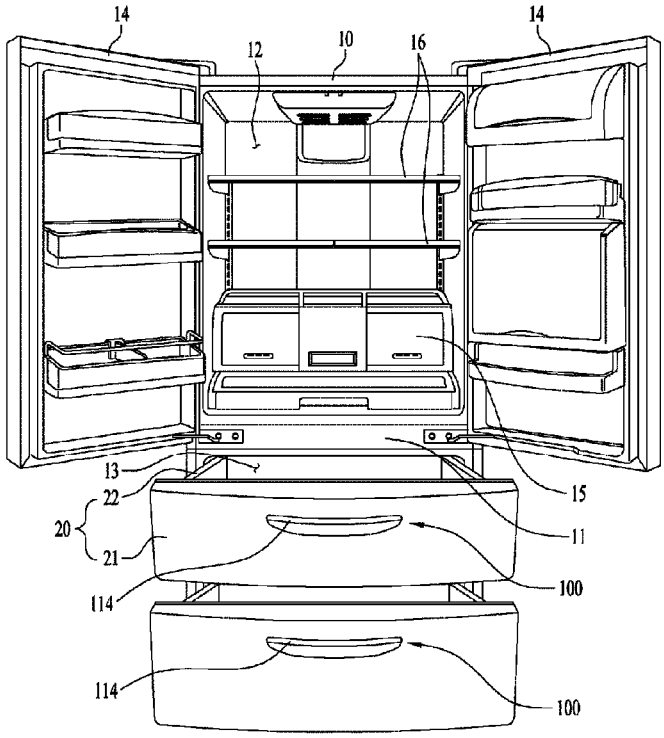
FIG. 1 is a front view illustrating an open state of a refrigerator according to the present invention.

Reference will now be made in detail to the preferred embodiments of the present invention, examples of which are illustrated in the accompanying drawings.

A refrigerator according to the present invention includes a main body 10 in which storage compartments 11 and 12 are defined, and doors 14 and 20 coupled to the main body 10 to open and close the storage compartments 11 and 12.

The storage compartments 11 and 12 include a refrigerating compartment 12 defined in an upper region of the main body 10, and a freezing compartment 13 defined in a lower region of the main body 10. Upper and lower positions of the refrigerating compartment 12 and the freezing compartment 13 may be reversed, and the entire main body 10 may define only the refrigerating compartment 12 or the freezing compartment 13.

A partition 11 is interposed between the refrigerating compartment 12 and the freezing compartment 13 to separate the compartments 12 and 13 from each other.

A drawer 15 in which stored items are accommodated and a shelf 16 are provided inside the refrigerating compartment 12. The door 14 is coupled to an upper portion of the main body 10 to open and close the refrigerating compartment 12.

The door 20 is located in front of the freezing compartment 13 and is slidingly movable to or from the main body 10 to open and close the freezing compartment 13.

The door 20 includes a door panel 21 provided at a front surface of the door 20 and an extension 22 extending rearward from the door panel 21.

A storage box for storage of items may be mounted to the extension 22.

A door opening unit 100 is mounted in a front portion of the door 20.

The door opening unit 100 is connected to a handle 120 (120, see FIG. 2) and is adapted to press the partition 11 via pivotal rotation of the handle 120. Thereby, the door opening unit 100 serves to move the door 20 away from the main body 10, thereby opening the freezing compartment 13.

Reference numeral 114 designates a handle cover affixed to the handle 120.

Figure 2:
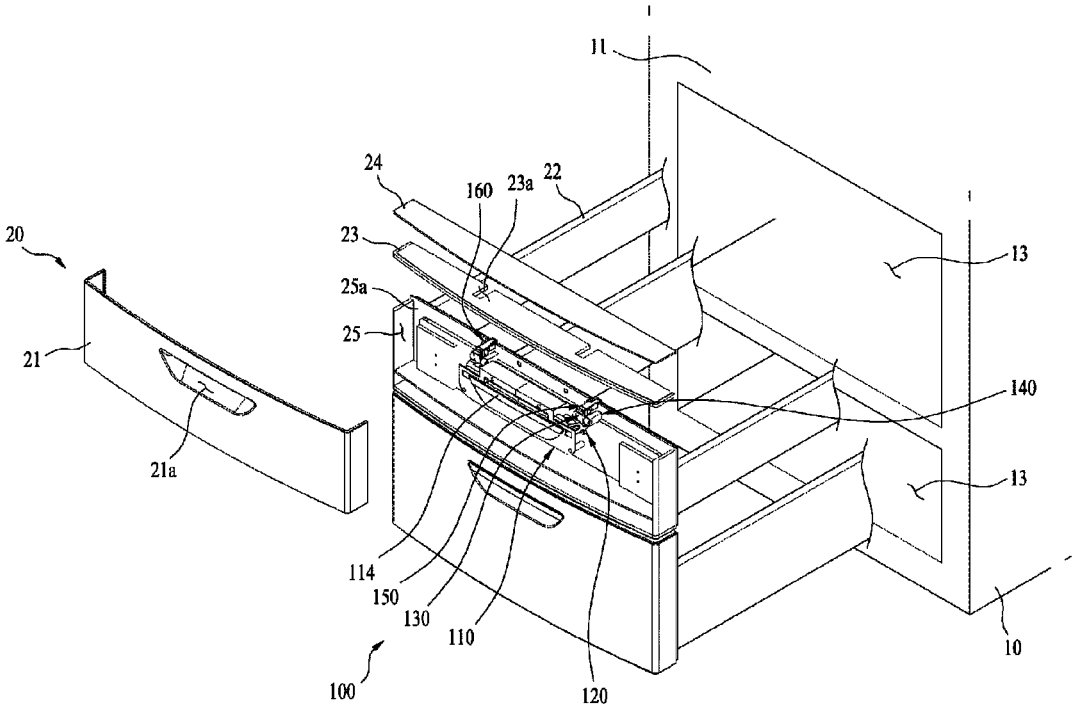
FIGS. 2 and 3 are exploded perspective views of a door according to the present invention.
Figure 3:
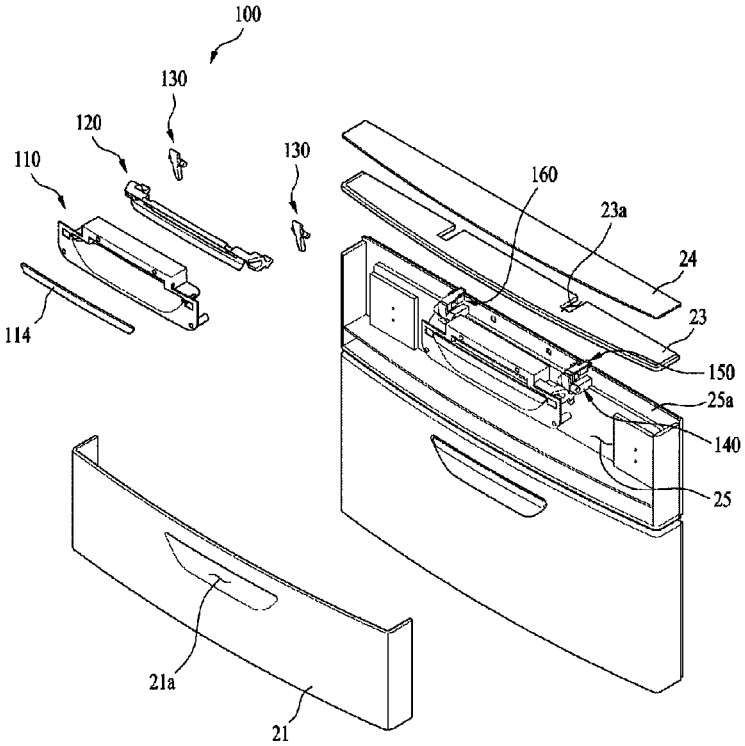

As illustrated in FIGS. 2 and 3, the door 20 includes the door panel 21 and the extension 22.

An installation space 25 in which the handle 120 and the door opening unit 100 are installed is defined at the rear of the door panel 21.

The top of the door 20, more particularly, the top of the installation space 25 is covered with a top cover 23. The top cover 23 has more than one guide slot 23*a*, through which a pressure unit 150 of the door opening unit 100 is exposed outward. The guide slot 23*a* serves to guide movement of the pressure unit 150. A top panel 24 is placed over the top cover 23 to prevent the top cover 23 and the pressure unit 150 from being exposed outward.

The top panel 24 and the door panel 21 preferably have the same texture and color.

The door panel 21 has an opening 21*a* to provide a pivotal rotation space for the handle 120.

The handle 120 is pivotally rotatably placed at the rear of the door panel 21. The handle 120 is pivotally rotatably mounted to the door opening unit (100, see FIG. 1).

The door opening unit (100, see FIG. 1) consists of a support frame 110 to pivotally rotatably support the handle 120, push units 130, support units 140, pressure units 150 and guide units 160.

Each push unit 130 has a lower portion inserted into either lateral end of the handle 120 such that upper and lower portions of the push unit 130 are moved in opposite directions according to pivotal rotation of the handle 120, thereby providing push force toward the main body 10.

The support units 140 are arranged at fixed positions within the installation space 25 and serve to support the push units 130 in a pivotally rotatable manner.

If the handle 120 is pulled to pivotally rotate forward in a state in which the push units 130 are supported in a pivotally rotatable manner by the support units 140, the lower portion of each push unit 130 is pulled forward by the handle 120, and simultaneously the upper portion of the push unit 130 is pushed rearward, thereby acting to push the pressure unit 150.

On the contrary, if the handle 120 is returned to an original configuration thereof, the lower portion of the push unit 130 is moved rearward, and simultaneously the upper portion of the push unit 130 is moved forward.

This is possible because the support unit 140 is located at the middle of the upper portion and the lower portion of the push unit 130 so as to pivotally rotatably support the middle portion of the push unit 130.

One end of the pressure unit 150 is positioned to come into contact with the upper portion of the push unit 130 and the other end of the pressure unit 150 is positioned to come into contact with a front surface of the main body 10.

Accordingly, if the push unit 130 pushes one end of the pressure unit 150, the pressure unit 150 applies pressure to the front surface of the main body 10, thereby causing the door 20 to be moved forward and spaced apart from the front surface of the main body 10 by reaction to the pressure. Through this movement of the door 20, the freezing compartment 13 is opened.

A lower surface and both lateral surfaces of the pressure unit 150 are supported by the guide unit 160. The guide unit 160 serves to guide forward and rearward sliding of the pressure unit 150.

Once the cover 23 is installed at the top of the installation space 25 in a state in which the pressure unit 150 is supported by the guide unit 160 as described above, the pressure unit 150 is exposed through the guide slit 23*a*.

The guide slit 23*a* is shaped to correspond to a sliding path of the pressure unit 150 and has an open rear end.

This configuration allows the other end of the pressure unit 150 to come into contact with the front surface of the main body 10.

Then, the top panel 24 is installed over the pressure unit 150 and an upper surface of the top cover 23 to prevent an upper surface of the pressure unit 150 from being exposed outward.

Figure 4:
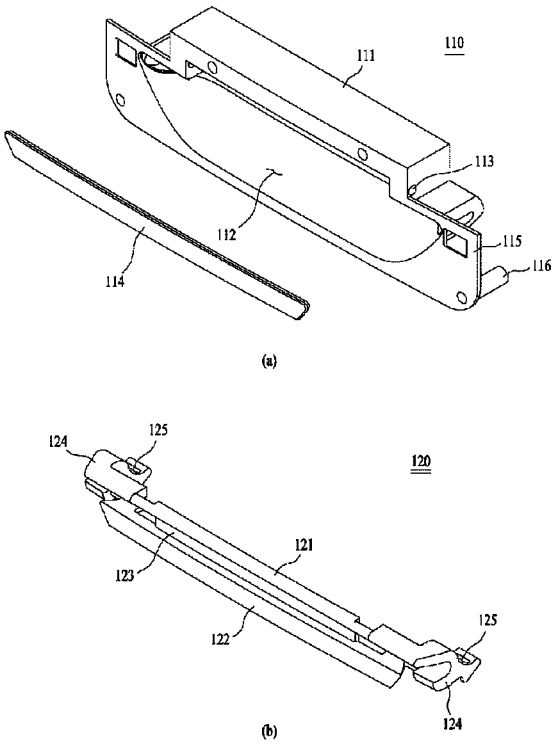
FIG. 4(*a*) is a perspective view of a support frame according to the present invention.

As illustrated in FIG. 4(*a*), the support frame 110 includes a body 111 that is mounted in the installation space (25, see FIG. 2) of the door (20, see FIG. 2), a space 112 that is defined in the body 111 at the rear of the opening (21*a*, see FIG. 2) to provide a pivotal rotation space for the handle 120 in conjunction with the opening 21*a*, and insertion holes 113 formed in the body 111, into which both ends of the handle 120 are inserted and supported to enable pivotal rotation of the handle 120.

The body 111 is provided at a front end thereof with a support plate 115. The support plate 115 is configured to come into contact at a front surface thereof with a rear surface of the door panel (21, see FIG. 2), such that the support frame 110 may be supported by the rear surface of the door panel 21.

More than one protrusion 116 extends rearward from a rear surface of the support plate 115. The protrusion 116 is fixed to a back wall of the installation space 25 (25*a*, see FIG. 2) to secure the support frame 110 within the installation space 25.

A thermal insulating member is introduced into the installation space 25. The protrusion 116 is embedded in the insulating member to secure the support frame 110 to the insulating member.

The insertion holes 113 are formed in opposite lateral surfaces of an upper portion of the body 111. Both ends of a pivot shaft 121 of the handle 120 that will be described hereinafter are inserted into the insertion holes 113 such that the pivot shaft 121 is supported in a pivotally rotatable manner by the body 111.

As illustrated in FIG. 4(*b*), the handle 120 includes the pivot shaft 121, a grip part 122, and a connecting part 123. The pivot shaft 121 is placed to extend in a left-and-right direction and is pivotally rotatably supported by the support frame 110 so as to serve as a pivot center of the handle 120. The grip part 122 is placed to extend in a left-and-right direction to assist a user in gripping the handle 120. The connecting part 123 is configured to connect the grip part 120 and the pivot shaft 121 to each other.

The connecting part 123 connects an upper portion of the grip part 122 and a lower portion of the pivot shaft 121 to each other.

A handle cover 114 is attached to a front surface of the grip part 122. The texture and color of the handle cover 114 are preferably equal or similar to those of the door panel (21, see FIG. 2).

The pivot shaft 121 is provided at both lateral ends thereof with moving parts 124, respectively. Each moving part 124 is configured such that the push unit (130, see FIG. 5) is inserted into the moving part 124, and serves to move the push unit 130 according to pivotal rotation of the handle 120.

The moving part 124 has an insertion hole 125 into which the push unit 130 is inserted.

The lower portion (133, see FIG. 5) of the push unit 130 is inserted into the insertion hole 125. In such an inserted state, if the user pulls the grip part 122 of the handle 120 forward, the handle 120 is pivotally rotated about the pivot shaft 121 and the moving part 124 is moved forward, thereby pulling the lower portion of the push unit 130 forward.

Figure 5:
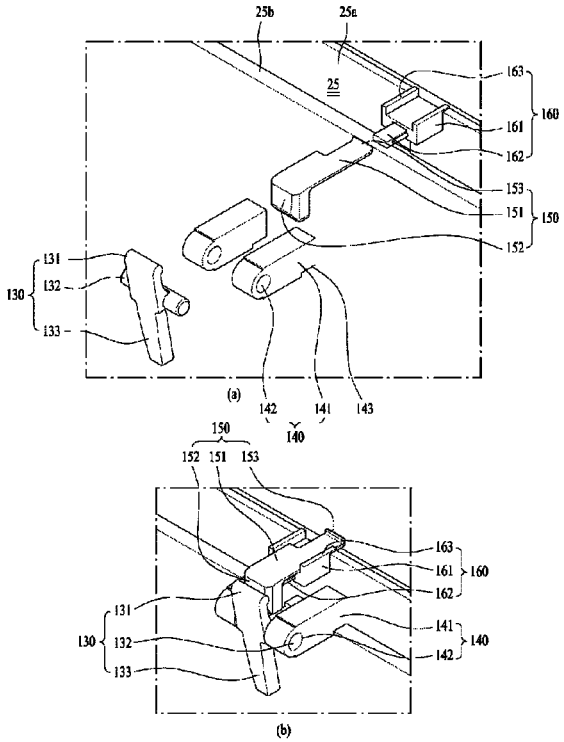
FIG. 5(*a*) is an exploded perspective view of a push unit and a pressure unit according to the present invention.

As illustrated in FIG. 5, the push unit 130 takes the form of a vertically extending bar or stick.

The push init 130 is composed of the upper portion 131, the lower portion 133, and a support shaft 132 located between the upper portion 131 and the lower portion 133.

The lower portion 133 may be inserted into the insertion hole (125, see FIG. 4) of the handle (120, see FIG. 4) and may be moved forward or rearward according to movement of the handle 120.

The upper portion 131 may come into contact at a rear surface thereof with one end of the pressure unit 150. The upper portion 131 may be configured to selectively push the pressure unit 150 toward the main body (10, see FIG. 2) according to movement of the lower portion 133.

The support shaft 132 is located between the lower portion 133 and the upper portion 131 and is pivotally rotatably inserted into the support unit 140, thereby serving to pivotally rotatably support the push unit 130.

The support shaft 132 is preferably placed to protrude laterally from both lateral surfaces of the push unit 130.

With the above described configuration, if the lower portion 133 is pulled forward by the handle (120, see FIG. 4), the upper portion 131 is moved rearward via pivotal rotation of the push unit 130, thereby pushing the pressure unit 150 rearward.

On the other hand, if the lower portion 133 is pushed rearward by the handle 120, the upper portion 131 is moved forward via pivotal rotation of the push unit 130, thereby being returned to an original position thereof.

That is, as the support shaft 132, which serves as the pivot center of the push unit 130, is placed between the upper portion 131 and the lower portion 133, a movement direction of the upper portion 131 is completely opposite to a movement direction of the lower portion 133.

The support unit 140 is fixed to the back wall 25*a* of the installation space 25. The support unit 140 preferably has a block shape.

The support unit 140 includes a body 141, one end of which is fixedly installed to the back wall 25*a* of the installation space 25, and a support hole 142 perforated in the body 141 at a position adjacent to the other end of the body 141, into which the support shaft 132 of the push unit 130 is inserted so as to be supported by the support unit 140.

Preferably, a pair of support units 140 is provided to support both lateral surfaces of each push unit 130.

As the support shaft 132 is pivotally rotatably inserted through the support hole 142, the push unit 130 may be stably placed within the installation space 25 so as to be pivotally rotatable by the support units 140.

Preferably, the support unit 140 is provided at a lower surface thereof with a stepped portion 143 adjacent to one end thereof, and the stepped portion 143 is engaged with a stepped portion 25*b* of the back wall 25*a*. This serves to allow the support unit 140 to be more stably installed to the back wall 25*a*.

The pressure unit 150, provided at the rear of the push unit 130, includes a contact part 152 and a pressure part 151. The contact part 152 is configured to come into contact with the rear surface of the push unit 130 and is moved by the push unit 130. The pressure part 151 is connected to the contact part 152 to come into contact with the main body (10, see FIG. 2) and serves to apply pressure to the main body 10 according to movement of the contact part 152.

The pressure unit 150 has an L-shaped form. Preferably, the pressure part 151 is placed to extend horizontally, and the contact part 152 is connected to a front end of the pressure part 151 and is placed to extend vertically, i.e. to extend downward from the front end of the pressure part 151.

The contact part 152 that extends downward may serve to increase a contact area with the upper portion of the push unit 130.

A contact point between the upper portion 131 of the push unit 130 and the contact part 152 may be displaced as the upper portion 131 of the push unit 130 is moved forward or rearward. The contact part 152 that extends downward by a predetermined length may ensure continuous contact despite displacement of the contact point.

The pressure unit 150 further includes a pressure rib 153 formed at a rear end of the pressure part 151 to increase a contact area with the main body 10. The pressure rib 153 preferably extends upward or downward from the rear end of the pressure part 151.

The pressure rib 153 is configured to come into contact with the front surface of the main body 10 and serves to apply pressure to the main body 10 when the push unit 130 pushes the pressure unit 150.

The lower surface and lateral surfaces of the pressure unit 150 are supported by the guide unit 160.

The guide unit 160 includes support parts 161 and 163 that are placed on the top of the door 20 to support the pressure part 151 in a slidingly movable manner, and an elastic support part 162 that is formed at the support part 161 to elastically support the contact part 152 to provide the contact part 152 with elastic restoration force.

The support parts 161 and 163 include a lower surface support part 161 to support the lower surface of the pressure part 151, and lateral surface support parts 163 extending upward from lateral surfaces of the lower surface support part 161 to support the lateral surfaces of the pressure part 151.

As the lateral surface support parts 163 support the lateral surfaces of the pressure part 151 and the lower surface support part 161 supports the lower surface of the pressure part 151, the pressure part 151 is supported in a slidingly movable manner by the support parts 161 and 163, and the support parts 161 and 163 guides sliding of the pressure part 151.

The elastic support part 162 is formed at a front end of the lower surface support part 161. The elastic support part 162 consists of a stick-shaped portion that extends forward from the lower surface support part 161 to come into contact with the contact part 152, and an elastic member (not shown) that is embedded in the lower surface support part 161 to elastically support the stick-shaped portion.

Accordingly, if the pressure unit 150 is pushed rearward by the push unit 130, the stick-shaped portion of the elastic support part 162 is pushed to thereby be inserted into the lower surface support part 161. When the elastic member is compressed by the stick-shaped portion, elastic restoration force is accumulated in the elastic support part 162.

If pressure applied to the pressure unit 150 by the push unit 130 is removed, the elastic member is expanded, causing the stick-shaped portion to protrude forward. Thereby, as the elastic support part 162 pushes the contact part 152 of the pressure unit 150, the pressure unit 150 is returned to an original position thereof.

Operation of the present invention will now be described with reference to FIGS. 6 to 9.

Figure 6:
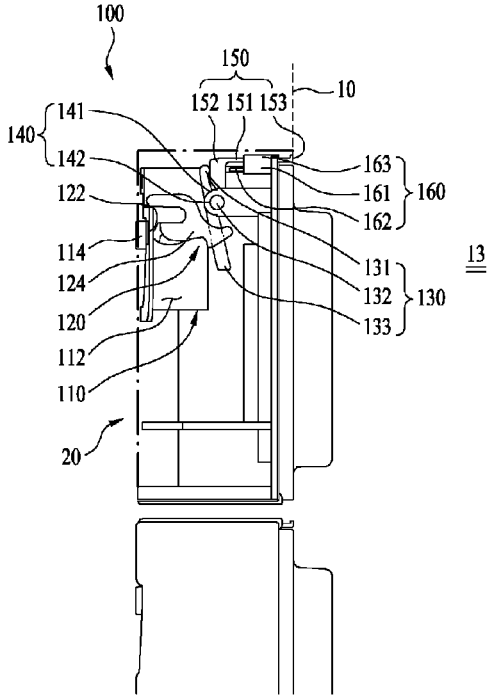
FIG. 6 is a side sectional view illustrating a closed state of the door according to the present invention.
Figure 7:
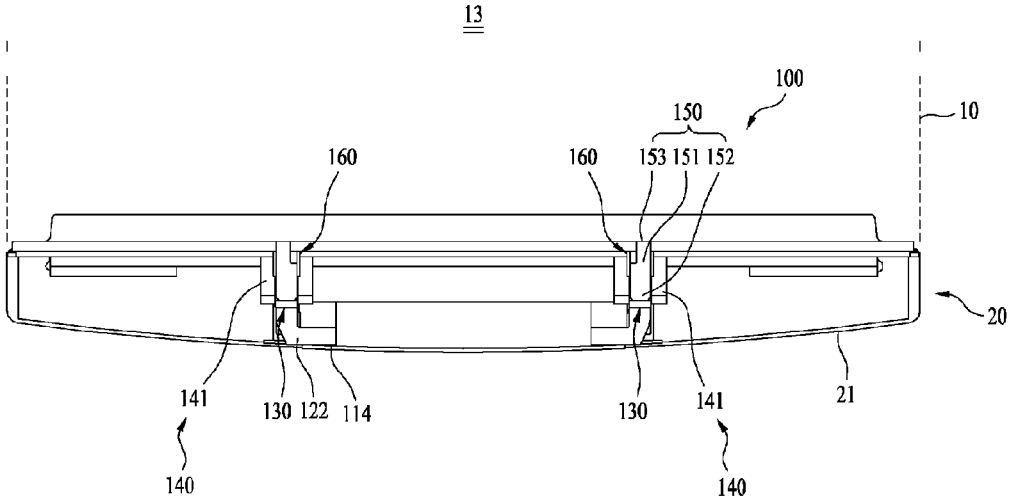
FIG. 7 is a plan view illustrating the closed state of the door according to the present invention.

FIGS. 6 and 7 illustrate a state in which the door 20 comes into contact with the main body 10 to close the freezing compartment 13.

In this case, the handle 20 is received inside the support frame 110 and remains not to be exposed forward of the front surface of the door 20.

The lower portion 133 of the push unit 130 remains inserted in the handle 120.

The lower portion 133 of the push unit 130 remains at a position rearward of the upper portion 131.

The upper portion 131 of the push unit 130 remains in contact with the contact part 152 of the pressure unit 150.

In this case, the contact part 152 of the pressure unit 150 remains elastically supported by the elastic support part 162 while being spaced apart from the lower surface support part 161 of the guide unit 160.

The pressure part 151 of the pressure unit 150 remains supported by the guide unit 160, and the rear end of the pressure part 151, i.e. the pressure rib 153 of the pressure unit 150 remains in contact with the front surface of the main body 10.

Figure 8:
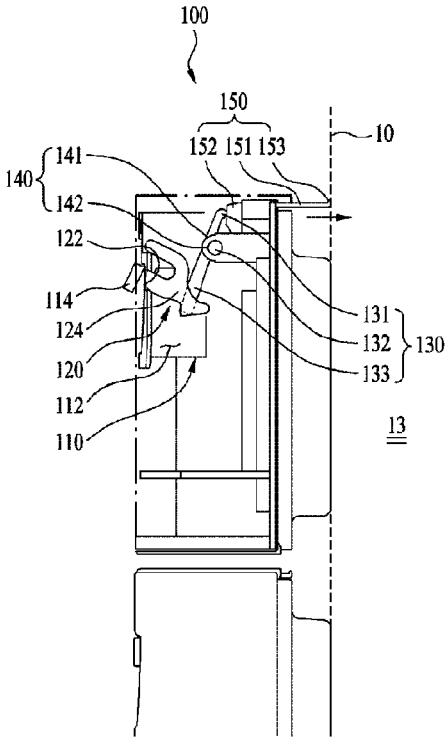
FIG. 8 is a side sectional view illustrating an open state of the door according to the present invention.
Figure 9:
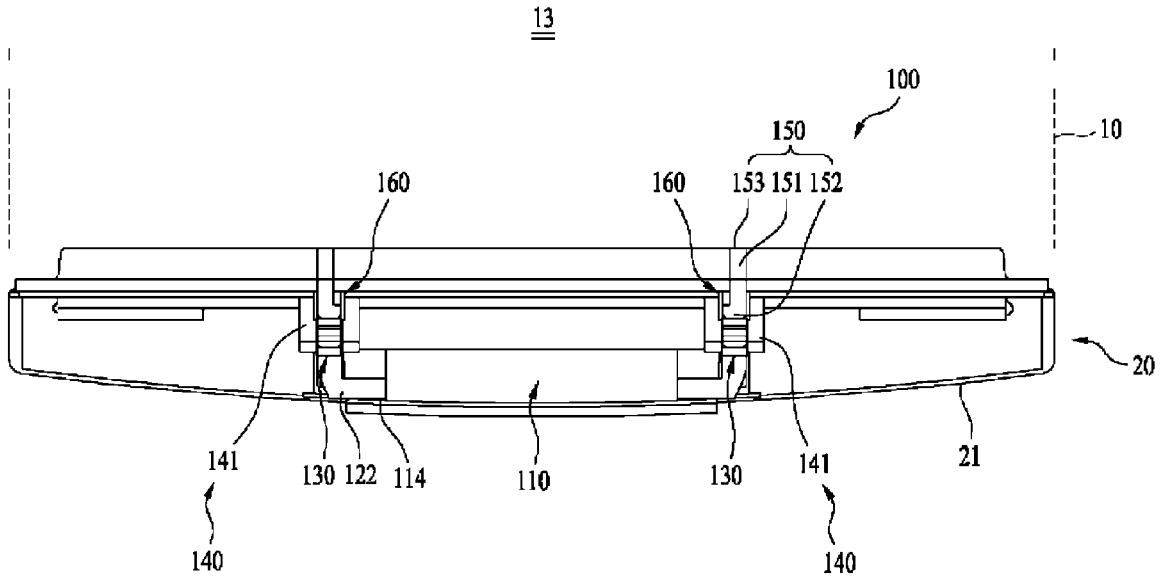
FIG. 9 is a plan view illustrating the open state of the door according to the present invention.

As illustrated in FIGS. 8 and 9, if the user pivotally rotates the handle 120 while gripping the grip part 122, the grip part 122 of the handle 120 is moved upward via forward pivotal rotation of the handle 120.

On the contrary, the moving part 124 of the handle 124 is moved downward via forward pivotal rotation of the handle 120.

The lower portion 133 of the push unit 130 is connected to the moving part 124 of the handle 120. Thus, as the moving part 124 of the handle 120 is moved downward, the lower portion 133 of the push unit 130 is pulled forward.

The upper portion 131 of the push unit 130 is moved rearward as the lower portion 133 is pulled forward, thereby serving to push the contact part 152 of the pressure unit 150 rearward.

Once the contact part 152 of the pressure unit 150 is pushed rearward by the push unit 130, the pressure part 151 of the pressure unit 150 is moved rearward under guidance of the support parts 161 and 163 of the guide unit 161.

In this case, the elastic support part 162 is also pushed by the contact part 152 and is moved rearward until it is received in the lower surface support part 161.

The rearwardly pushed pressure part 151 applies pressure to the front surface of the main body 10.

However, even if pressure is applied to the front surface of the main body 10 by the pressure part 151, the main body 10 is not moved. Instead, by reaction to the applied pressure, the door 20, to which the door opening unit 100 is mounted, is forced in a completely opposite direction of the pressure applied by the pressure part 151, i.e. is forced forward.

As the door 20 is further moved forward after the rear surface of the door 20 is spaced apart from the front surface of the main body 10, the freezing compartment 13 is opened by the door 20.

That is, the door 20 may be spaced apart from the main body 10 to open the freezing compartment 13 as the user simply pulls the handle 120 forward to pivotally rotate the handle 120 even without directly pulling the door 20.

Once the door 20 is spaced apart from the main body 10, the user can increase an opening rate by pulling the door 20 forward. The interior pressure of the freezing compartment 13 is less than an outside atmospheric pressure in a state in which the freezing compartment 13 is closed by the door 20, and therefore force is applied from the door 20 toward the freezing compartment 13 by a pressure gradient.

Accordingly, although a strong force is required to release the forced state, the elderly and infirm persons, women and children may have a difficulty in providing the strong force.

However, according to the present invention, once the door 20 is spaced apart from the main body 10 as the user pivotally rotates the handle 20, air is introduced into a gap between the door 20 and the main body 10, which causes the interior pressure of the freezing compartment 13 and the outside atmospheric pressure to be equal to each other. In this way, the door 20 is slidingly moved even when slightly pulled forward, thereby completely opening the freezing compartment 13.

Then, if the user pushes the door 20 after the user puts items into or takes items out of the freezing compartment 13 in an open state of the door 20, the door 20 is slidingly moved until the rear surface of the door 20 comes into contact with the front surface of the main body 10, thereby closing the freezing compartment 13, as illustrated in FIGS. 6 and 7.

More specifically, the front surface of the main body 10 comes into contact with the pressure part 151 of the pressure unit 150 and forces the pressure unit 150 to move the pressure unit 150 forward. Through forward movement of the pressure unit 150, the upper portion 131 of the push unit 130 is moved forward.

Simultaneously, the elastic support part 162 pushes the contact part 152 of the pressure unit 150 forward.

The lower portion 133 of the push unit 130 is moved rearward, pulling the moving part 124 of the handle 120 rearward. As such, the handle 120 is pivotally rotated rearward.

As the grip part 124 of the handle 120 is introduced into and received in the space 112 of the support frame 110 through rearward pivotal rotation of the handle 120, the door opening unit 100 and the handle 120 are returned to an original configuration thereof before opening of the door 20.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

MODE FOR THE INVENTION

As described above, a related description has sufficiently been discussed in the above "Best Mode" for implementation of the present invention.

INDUSTRIAL APPLICABILITY

As described above, the present invention may be wholly or partially applied to a refrigerator having a door opening unit.

The invention claimed is:

1. A refrigerator comprising:

a main body having a storage compartment;

a door coupled to the main body in a slidingly movable manner to open and close the storage compartment;

a handle provided at the door in a pivotally rotatable manner; and a door opening unit connected to the handle to come into contact with the main body, the door opening unit serving to move the door by applying pressure to the main body via pivotal rotation of the handle, thereby opening the storage compartment, wherein the door opening unit includes:

a support frame configured to support the handle in a pivotally rotatable manner;

a plurality of push units inserted into the handle and spaced apart from each other within the door, an upper portion of each push unit being movable to or from the main body via pivotal rotation of the handle; and a plurality of pressure units configured to come into contact with the plurality of push units, respectively, and adapted to be selectively moved by movement of the push units, the pressure units being spaced apart from one another within the door to cause sliding of the door by applying pressure to a partition of the main body;

wherein the handle includes:

a grip part configured to enable gripping by a user;

a pivot shaft pivotally rotatably provided at the support frame and serving as a pivot center;

a connecting part configured to connect the grip part and the pivot shaft to each other; and a moving part provided at an end of the pivot shaft and having an insertion hole, into which a corresponding one of the push unit is inserted, the moving part serving to pull a lower portion of the push unit and move an upper portion of the push unit toward the main body when the handle is pivotally rotated forward.

2. The refrigerator according to claim 1, wherein the door opening unit is configured to come into contact with a front surface of the main body and applies pressure to the front surface of the main body so as to move the door upon pivotal rotation of the handle.

3. The refrigerator according to claim 2, wherein the door includes:

a door panel placed at a front surface of the door; and an opening formed in the door panel to define a space for pivotal rotation of the handle, the handle and the door opening unit being mounted in the space.

4. The refrigerator according to claim 1, wherein the handle further includes a handle cover affixed to a front surface of the grip part.

5. The refrigerator according to claim 1, wherein the support frame includes:

a body mounted to the door;

a space formed in the body to define a pivotal rotation space of the handle in conjunction with the opening; and an insertion hole formed in the body, into which the handle is inserted and supported in a pivotally rotatable manner.

6. The refrigerator according to claim 5, wherein the support frame includes a plurality of protrusions protruding rearward from a rear surface of the support frame, the protrusions being coupled to an insulating member placed in the door, and wherein the protrusions are arranged on the rear surface of the support frame and are spaced apart from one another.

7. The refrigerator according to claim 1, further comprising a support unit to pivotally rotatably support each push unit.

8. The refrigerator according to claim 7, wherein the push unit includes:

a lower portion configured to be inserted into the handle so as to be moved according to movement of the handle;

an upper portion configured to come into contact with a corresponding one of the pressure units, the upper portion serving to selectively push the pressure unit toward the main body according to movement of the lower portion; and a support shaft provided between the lower portion and the upper portion, the support shaft being pivotally rotatably inserted into the support unit to pivotally rotatably support the push unit.

9. The refrigerator according to claim 1, wherein each of the pressure units includes:

a contact part configured to come into contact with a corresponding one of the push units and be moved by pushing operation of the push unit; and a pressure part connected to the contact part and configured to come into contact with the main body to apply pressure to the main body according to movement of the contact part.

10. The refrigerator according to claim 9, wherein the pressure unit further includes a pressure rib provided at an end of the pressure part and configured to increase a contact area with the main body.

11. The refrigerator according to claim 9, wherein the pressure part is placed to horizontally extend; and wherein the contact part is connected to the pressure part and is placed to vertically extend.

12. The refrigerator according to claim 9, further comprising a guide unit configured to support the pressure unit in a slidingly movable manner, the guide unit serving to guide movement of the pressure unit.

13. The refrigerator according to claim 12, wherein the guide unit includes: a support part placed on an upper surface of the door and configured to support the contact part in a slidingly movable manner; and an elastic support part provided at the support part and configured to elastically support the contact part for provision of elastic restoration force.

14. The refrigerator according to claim 13, wherein the support part includes:

a lower surface support part configured to support a lower surface of the contact part;

and a lateral surface support part configured to extend upward from a lateral surface of the lower surface support part so as to support a lateral surface of the contact part.

15. The refrigerator according to claim 1, further comprising: a top cover placed over the door and having a guide slot to guide movement of a corresponding one of the pressure units exposed therethrough; and a top panel placed over the top cover and configured to prevent exposure of the top cover and the pressure unit.

16. A refrigerator comprising:

a main body having a storage compartment;

a door coupled to the main body in a slidingly movable manner to open and close the storage compartment;

a handle provided at the door in a pivotally rotatable manner; and a door opening unit connected to the handle to come into contact with the main body, the door opening unit serving to move the door by applying pressure to the main body via pivotal rotation of the handle, thereby opening the storage compartment, wherein the door opening unit is configured to come into contact with a front surface of the main body and applies pressure to the front surface of the main body so as to move the door upon pivotal rotation of the handle;

wherein the handle includes:

a grip part configured to enable gripping by a user;

a pivot shaft pivotally rotatably provided at the support frame and serving as a pivot center;

a connecting part configured to connect the grip part and the pivot shaft to each other; and a moving part provided at an end of the pivot shaft and having an insertion hole, into which a push unit is inserted, the moving part serving to pull a lower portion of the push unit so as to move an upper portion of the push unit toward the main body when the handle is pivotally rotated forward.

17. The refrigerator according to claim 16, wherein the door opening unit includes:

a support frame configured to support the handle in a pivotally rotatable manner, the support frame being placed at the rear of an opening formed in the door;

a plurality of push units inserted into the handle and spaced apart from each other within the door, the upper portion of each push unit being movable to or from the main body via pivotal rotation of the handle; and a plurality of pressure units configured to come into contact with the plurality of push units, respectively, and adapted to be selectively moved by movement of the push units, the pressure units being spaced apart from one another within the door to cause sliding of the door by applying pressure to a partition of the main body.

18. The refrigerator according to claim 16, wherein the door includes an opening formed in a door panel that is placed at a front surface of the door, the opening defining a space for pivotal rotation of the handle, the handle and the door opening unit being mounted in the space.

* * * * *